United States Patent [19]

Mailand et al.

[11] Patent Number: 4,484,932

[45] Date of Patent: Nov. 27, 1984

[54] SANDING WHEEL

[75] Inventors: John J. Mailand, Wyoming Township, Chisago County; Warren L. Langstraat, Cottage Grove, both of Minn.; Daniel D. Smith, Rankin County, Miss.

[73] Assignee: Minnesota Mining and Manufacturing Company, Saint Paul, Minn.

[21] Appl. No.: 561,988

[22] Filed: Dec. 14, 1983

Related U.S. Application Data

[63] Continuation of Ser. No. 309,898, Oct. 9, 1981, abandoned.

[51] Int. Cl.[3] ..... B24D 9/06

[52] U.S. Cl. ..... 51/335; 51/360

[58] Field of Search ..... 51/330, 331, 332, 334, 51/335, 336, 337, 358, 359, 360, 364; 312/38, 39, 41

[56] References Cited

U.S. PATENT DOCUMENTS

| | | | |
|---|---|---|---|
| 564,587 | 7/1896 | Black | 51/335 |
| 674,384 | 5/1901 | Nash | 51/335 |
| 1,577,485 | 3/1926 | Nash | 51/360 |
| 2,194,577 | 3/1940 | Vonnegut . | |
| 2,215,151 | 9/1940 | Hill et al. . | |
| 2,418,966 | 4/1947 | Bonkowski . | |
| 2,533,619 | 12/1950 | Pokras . | |
| 2,637,956 | 5/1953 | Nuessle . | |
| 2,713,759 | 7/1955 | Swan . | |
| 2,854,798 | 10/1958 | De Haven | 51/335 |
| 3,132,452 | 5/1964 | Block . | |

*Primary Examiner*—Robert P. Olszewski

*Attorney, Agent, or Firm*—Donald M. Sell; James A. Smith; William L. Huebsch

[57] ABSTRACT

A motor-driven wheel for sanding irregular surfaces including a plurality of flexible support members projecting generally radially outwardly from a hub assembly and a plurality of separate nonconnected lengths of flexible abrasive-coated material projecting along the support members from within the hub assembly. Each of the lengths of abrasive-coated material is releasably secured in the hub assembly by separate members positioned adjacent the periphery of the hub assembly which permit, when released, individual movement of the individual lengths into or out of the hub assembly.

8 Claims, 7 Drawing Figures

SANDING WHEEL

This is a continuation of application Ser. No. 309,898 filed Oct. 9, 1981, now abandoned.

TECHNICAL FIELD

This invention relates to sanding wheels of the type adapted to sand both flat and irregular surfaces, which wheels store a reserve supply of abrasive-coated material in their hub assemblies.

BACKGROUND ART

Wheels of the type adapted to sand both flat and irregular surfaces such as may be present on wooden moldings are described in U.S. Pat. Nos. 2,194,577, 2,418,966, 2,533,619, 2,713,759 and 3,132,452. Generally that type of sanding wheel comprises a hub assembly adapted for engagement by a drive motor to rotate it in a first direction, a plurality of flexible support members (typically in the form of bristle brushes) fixed in the hub assembly and projecting generally radially outwardly of its periphery, and a plurality of lengths of flexible abrasive-coated material, outer end portions of which extend through slots in the periphery of the hub assembly and project along the leading sides of the support members so that when the hub assembly is rotated the projecting portions of the abrasive-coated material are resiliently backed by the support members during application thereof to a surface to be sanded. Portions of the lengths of abrasive-coated material are also stored within the hub assembly and means are provided for releasably securing the lengths of abrasive-coated material within the hub assembly so that after the projecting portions of the abrasive-coated material become dull or wear away, the means for releasably securing can be temporarily released so that fresh portions of the lengths of abrasive-coated material can be pulled through the slots and positioned along the support members.

In known sanding wheels of the aforementioned type, however, the lengths of abrasive-coated material each have one end permanently or releasably attached to a core, and the means for releasably securing the lengths of abrasive-coated material releasably locks the core in place within the hub assembly. While such an approach may be satisfactory for securing the lengths of abrasive-coated material, the cost of permamently attaching a plurality of lengths of abrasive-coated material to a core or adapting the lengths of abrasive-coated material to afford their releasable attachment to a core adds significantly to the cost of the abrasive-coated material used in the sanding wheel. Adjusting the position of the core adjusts the position of all of the lengths of abrasive-coated material which may not be necessary or desirable if the projecting portion of only a few of the lengths are dull or worn away. Fairly large end portions of the lengths of abrasive-coated material extending from the core to the periphery of the wheel can never be used, which is wasteful; and the wheels are generally difficult to re-load with new abrasive-coated material since typically they must be taken apart for that purpose.

DISCLOSURE OF THE INVENTION

The present invention provides an inexpensive sanding wheel of the type described above for sanding both flat and irregular surfaces, which sanding wheel is adapted to use individual lengths of abrasive-coated material which are not attached together or to a core during use on the wheel, but are held adjacent the periphery of the wheel, thereby minimizing the cost of the abrasive-coated material used in the wheel; and which lengths of abrasive-coated material can be individually loaded into the wheel without taking the wheel apart, and can have their positions individually adjusted on the wheel so that only dull or worn away projecting portions need be replaced.

According to the present invention there is provided a sanding wheel of the type comprising a hub assembly adapted to be engaged and rotated by a drive motor in a first direction; a plurality of flexible support members or brushes having one end fixed on the hub assembly and projecting generally radially outwardly of its periphery; and a plurality of lengths of flexible abrasive-coated material each extending through a slot in the hub assembly and being positioned so that its outer end portion will project along the leading surface of one of the support members, and having an inner end portion secured by means within the hub assembly. In the improved wheel according to the present invention the lengths of abrasive-coated material are separate and nonconnected, and the means for releasably securing them are located adjacent the periphery of the hub assembly and afford, when released, individual positioning, insertion or removal of the separate lengths of abrasive-coated material with respect to the hub assembly.

In a preferred embodiment the sanding wheel is adapted for use with lengths of abrasive-coated material having scalloped edges. The hub assembly comprises first and second portions defining a separate internal passageway for each of the lengths of abrasive-coated material with each of the hub portions defining a different edge of each of the passageways adjacent its periphery. The hub portions have lugs adjacent their periphery adapted to engage between the scallops along the edges of the lengths of abrasive-coated material along the passageway, and are relatively axially movable between a lock position with the lugs between scallops along the edges of the lengths of abrasive-coated material to hold the lengths of abrasive-coated material in the hub assembly, and a released position spaced to afford free movement of the lengths of abrasive-coated material along the passageways past the lugs. Also the sanding wheel comprises means for releasably holding the hub portions in the lock position which together with the scalloped edges, relatively movable hub portions, and the lugs provides the means for releasably securing the lengths of abrasive-coated material within the hub assembly.

Alternatively, however, the means for releasably securing the lengths of abrasive-coated material could be self-locking cams or spring-biased lock members (which lock members can pivotably support the support members) located adjacent the periphery of the hub assembly.

BRIEF DESCRIPTION OF DRAWING

The present invention will be more thoroughly described with reference to the accompanying drawing wherein like numbers refer to like parts in the several views, and wherein.

DESCRIPTION OF THE PREFERRED EMBODIMENTS

Figure 1:
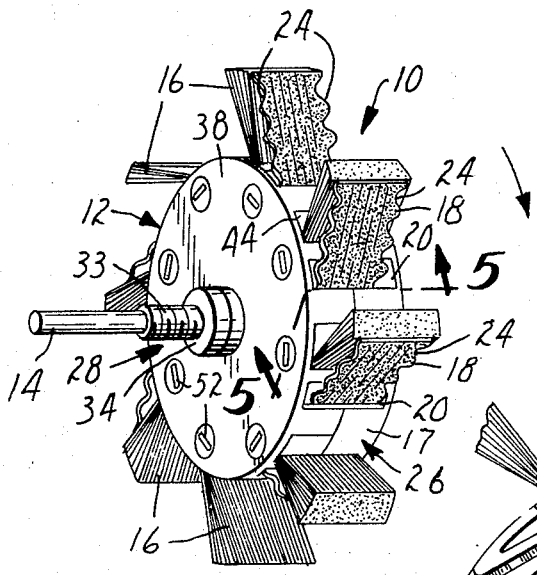
FIG. 1 is a perspective view of a first embodiment of a sanding wheel according to the present invention.
Figure 2:
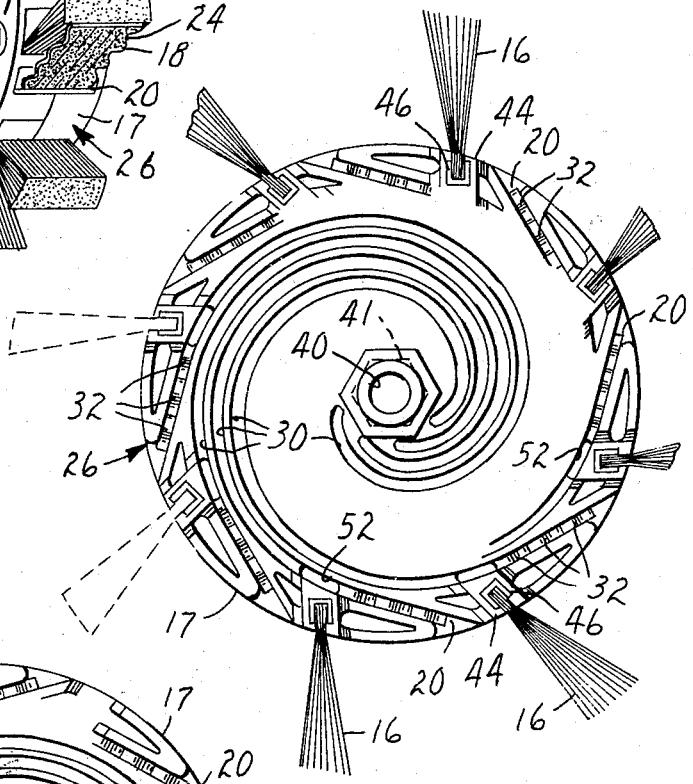
FIG. 2 is an inner side view of a first portion of the sanding wheel shown in FIG. 1.
Figure 3:
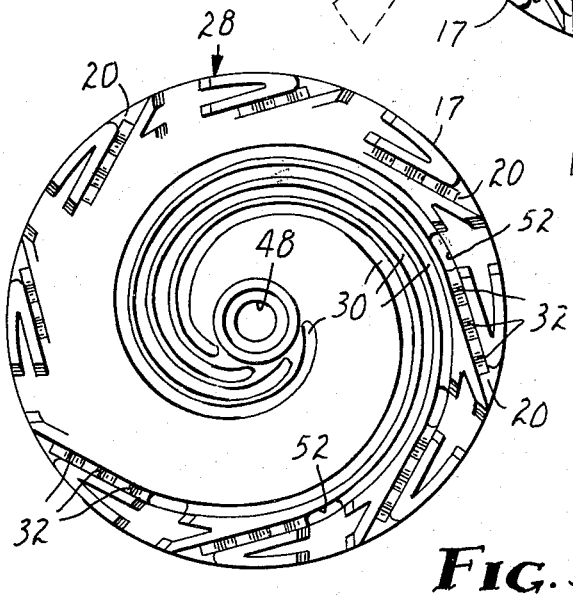
FIG. 3 is an inner side view of a second portion of the sanding wheel shown in FIG. 1.

Referring now to the drawing there is shown in FIGS. 1 through 5 a first embodiment of a sanding wheel according to the present invention generally designated by the reference numeral 10.

Briefly the sanding wheel 10 comprises a hub assembly 12 from which projects a distal end of a bolt 14 adapted to be engaged and rotated by a drive motor (not shown) to rotate the sanding wheel 10 in a first direction indicated by the arrow in FIG. 1, and a plurality of flexible support members or brushes 16 each having one end fixed in the hub assembly 12 and projecting generally radially outwardly of its periphery 17. A plurality of individual nonconnected lengths 18 of flexible abrasive-coated material each extend through a different slot 20 in the hub assembly 12 and are positioned so that their outer projecting end portions project along the surfaces of adjacent ones of the brushes 16 that lead when the wheel 10 is rotated in the first direction so that the projecting end portions of the lengths 18 of abrasive material can be yieldably pressed into abrasive engagement with a flat or irregular surface by the brushes 16.

Figure 5:
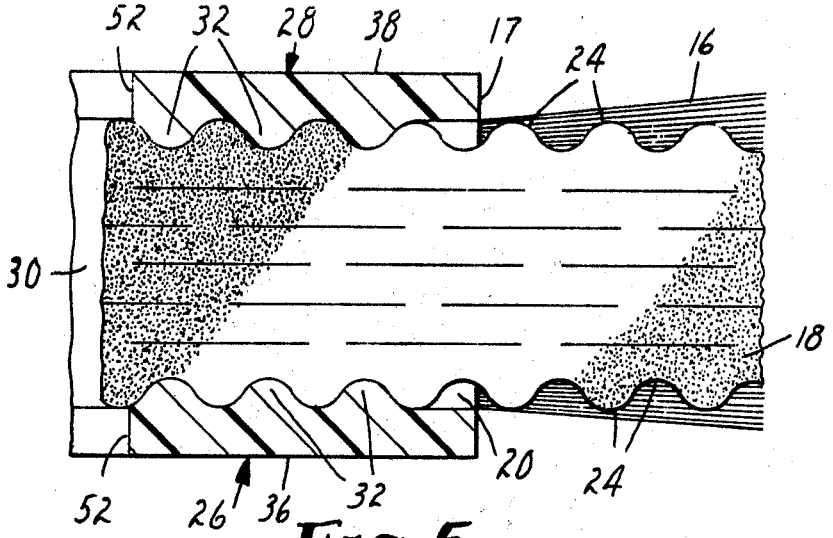
FIG. 5 is an enlarged fragmentary sectional view taken approximately along line 5—5 FIG. 1.
Figure 4:
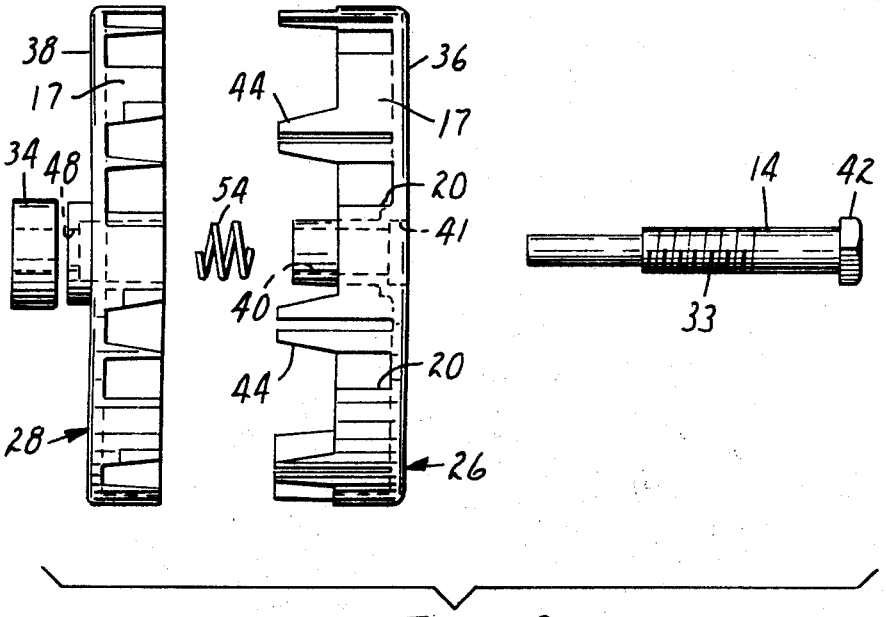
FIG. 4 is a front exploded view of the sanding wheel shown in FIG. 1.

As is seen in FIGS. 1 and 5, the lengths 18 of abrasive-coated material with which the wheel 10 is adapted to be used have scalloped edges 24. The hub assembly 12 comprises a first portion 26 (best seen in FIGS. 2 and 4) and a second portion 28 (best seen in FIGS. 3 and 4) which together define a separate helical passageway 30 for each of the lengths 18 of abrasive-coated material, with each of the hub portions 26 or 28 defining a different edge of each of the passageways 30. The portions 26 and 28 have lugs 32 (FIGS. 2, 3 and 5) adjacent their peripheries adapted to engage between the scallops along the edges 24 of the lengths 18 of abrasive-coated material along the passageways 30, and are relatively axially movable between a lock position (FIGS. 1 and 5) with the lugs 32 between the scallops to hold the lengths 18 of abrasive-coated material in the hub assembly 12, and a released position (not shown) spaced to afford free manual movement of the lengths 18 of abrasive-coated material in either direction along the passageways 30 past the lugs 32. Also the sanding wheel 10 comprises means including a threaded portion 33 of the bolt 14 and a knurled nut 34 for releasably holding the hub portions 26 and 28 in the lock position which, together with the scalloped edges 24, relatively movable hub portions 26 and 28, and the lugs 32 provides the means for releasably securing the lengths 18 of abrasive-coated material within the hub assembly 12.

The first and second portions 26 and 28 of the hub assembly 12 are each generally cylindrical and are formed, preferably by molding, of a rigid polymeric material (e.g., A.B.S., polypropylene, or high impact styrene). Each portion 26 or 28 has a circular end wall (36 and 38 respectively), from which end wall 36 or 38 project axially toward the other portion 26 or 28 spaced, matched guide walls defining therebetween halves of the passageways 30 leading to the slots 20, which passageways 30 are interleaved with each other and are helically disposed about the axis of the hub assembly 12. The first portion 26 has a central through axially-extending opening 40 through which the bolt 14 projects and has a recess 41 around the opening 40 in its end wall 36 adapted to receive a head 42 on the bolt 14 to prevent rotation of the bolt 14 relative to the first portion 26. The first portion 26 also includes a plurality of projecting channel-like parts 44 spaced around its periphery, which parts 44 are slotted through the peripheral surface 17 and are open at their distal ends to each receive (when the portions 26 and 28 are separated) a base 46 on one of the brushes 16 with bristles on the brush 16 projecting through a portion of the slot at the periphery 17 which is sufficiently narrow to preclude passage of the base 46 radially of the first portion 26. The second portion 28 has walls defining a central opening 48 that will slide axially along the bolt 14, and has sockets adapted to receive the projecting parts 44 of the first portion 26 when the portions 26 and 28 are in their lock position so that the end wall 38 will close the distal ends of the brush 16 receiving channels in the projecting parts 44, and the portions 26 and 28 will be keyed together to prevent relative rotation of the portions 26 and 28. Each portion 26 or 28 also has a slot or window 52 through its end wall 36 or 38 opening into each of the passageways 30 to afford a visual inspection to determine whether a significant amount of one of the lengths 18 of abrasive-coated material remains in the passageway 30.

The brushes 16 can include bristles of natural or polymeric materials, and are preferably formed of nylon bristles of a fairly large diameter (e.g., 0.015 inch or 0.038 cm.) which have been found to provide a more effective and long wearing support for the projecting portions of the lengths 18 of abrasive-coated material than natural bristles. Each brush 16 is formed in a conventional manner by bending lengths of the bristles 180 degrees around a rod (not shown) and clamping a generally U-shaped clasp over the portions of the bristles extending around the rod to form the base 46 for the brush 16.

The lengths 18 of abrasive-coated material are longitudinally scored (see FIG. 5) in a known manner so that their projecting portions supported on the brushes 16 can separate into longitudinal radially extending strips to help conform to an irregular surface. The scalloped edges on the lengths 18 of abrasive-coated material not only afford engagement by the lugs 32 to retain the lengths 18 of abrasive-coated material in place, but also restrict edge cutting of a workpiece by the abrasive-coated material, which is a known advantage of scalloped edged abrasive as is described in U.S. Pat. No. 2,637,956. High grade abrasive-coated material of any grit may be used in the wheel 10 with preferred abrasive materials being those sold under the trade designation Three-M-ite or Tri-M-ite by Minnesota Mining and Manufacturing Company of St. Paul, Minn. Grits of 60 and coarser have been found to be particularly advantageous when used on metal surfaces as they have a tendency to peen as well as abrade the surface and provide surprisingly high removal rates.

To use the sanding wheel 10 a user simply engages the distal end of the bolt 14 with the chuck of a drive motor such as an electric drill, activates the drive motor, and applies the projecting portions of the lengths 18 of abrasive-coated material supported against the brushes 16 to a workpiece. When one or more of the lengths 18 of abrasive-coated material need to be extended due to wear or need to be changed to provide another size grit, the user loosens the knurled nut 34 which allows the portions 26 and 28 of the hub assembly 12 to separate to their released position by movement of the second portion 28 along the bolt 14 (which movement is aided by the influence of a coil spring 54 around the bolt 14 between the portions 26 and 28), whereupon the lugs 32 separate from the scalloped edges 24 of the lengths 18 of abrasive-coated material and allow them to be moved freely along the passageways 30 and through the slots 20 to reposition or change them as desired. The nut 34 is then again tightened to move the portions 26 and 28 to their lock position with the lugs between the scallops along the edges 24, and the sanding wheel 10 is ready for further use.

Figure 6:
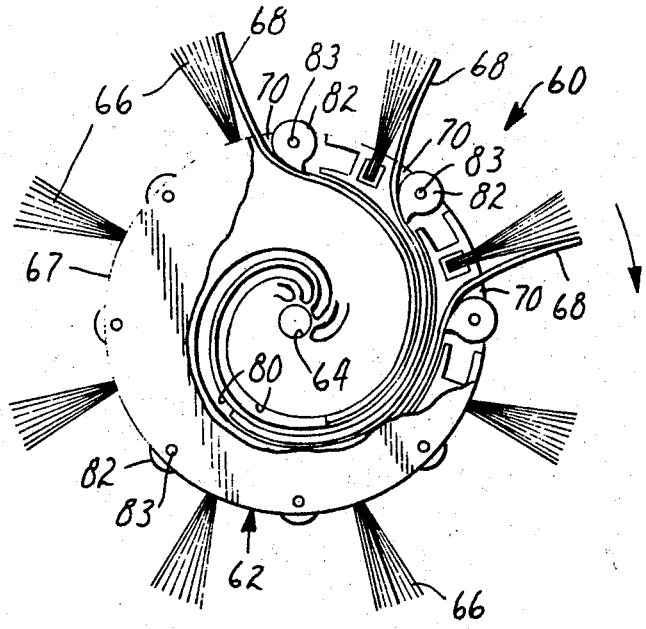
FIG. 6 is a side view of a second alternate embodiment of a sanding wheel according to the present invention having parts broken away to show details.

FIG. 6 illustrates a second alternate embodiment of a sanding wheel according to the present invention generally designated by the reference numeral 60.

Like the sanding wheel 10, the sanding wheel 60 comprises a cylindrical hub assembly 62 from which axially projects a shaft 64 having a distal portion adapted to be engaged and rotated by a drive motor (not shown) to rotate the sanding wheel 60 in a first direction indicated by an arrow in FIG. 6. A plurality of flexible support members or brushes 66 identical to the brushes 16, each have one end fixed on the hub assembly 62 by means similar to those used in the sanding wheel 10 and project generally radially outwardly of a cylindrical periphery 67 of the hub assembly 62. A plurality of individual nonconnected lengths 68 of flexible abrasive-coated material each extend through a different slot 70 in the periphery 67 of the hub assembly 62, and are positioned so that their outer projecting end portions project along the surfaces of adjacent ones of the brushes 66 that lead when the wheel 60 is rotated in the first direction so that the projecting end portions of the lengths 68 of abrasive-coated material can be yieldably pressed into abrasive engagement with a flat or irregular surface. The hub assembly 62 also comprises first and second portions which define a separate helical passageway 80 for each of the lengths 68 of abrasive-coated material, with each of the hub portions defining a different edge of each of the passageways 80.

Unlike the sanding wheel 10, however, the portions of the hub assembly 62 can be more permanently fixed together as by screws (not shown) and the means for releasably securing the lengths 68 of abrasive-coated material in the hub assembly 62 comprises a plurality of self-locking cams 82. Each cam 82 is mounted on a shaft 83 supported between the portions of the hub assembly 62 adjacent its periphery 67 for free rotation about an axis parallel to the axis of the hub assembly 62 between (1) a lock position with the periphery of the cam 82 pressing the lengths 68 of abrasive-coated material into engagement with a wall of the hub assembly 62 defining the passageway 80 for the length 68 of abrasive-coated material, and (2) a released position with the periphery of the cam 82 spaced from the length 68 of abrasive-coated material along that wall to permit movement of the length 68 of abrasive-coated material into or out of the passageway 80. Each cam 82 is shaped and oriented so that friction between the length 68 of abrasive-coated material and the cam 82 when the length 68 is pulled from the hub assembly 62 through the slot 20 will rotate the cam 82 toward its lock position. Thus centrifugal force or engagement with a workpiece will not throw or pull the lengths 68 of abrasive-coated material from the hub assembly 62. The cams 82 can be rotated to their released positions by pushing the lengths 68 of abrasive-coated material into the passageways 80, however, and the cams 82 can then be manually held in their released positions so that the lengths 68 of abrasive-coated material can be freely pulled out of the passageways 80.

Figure 7:
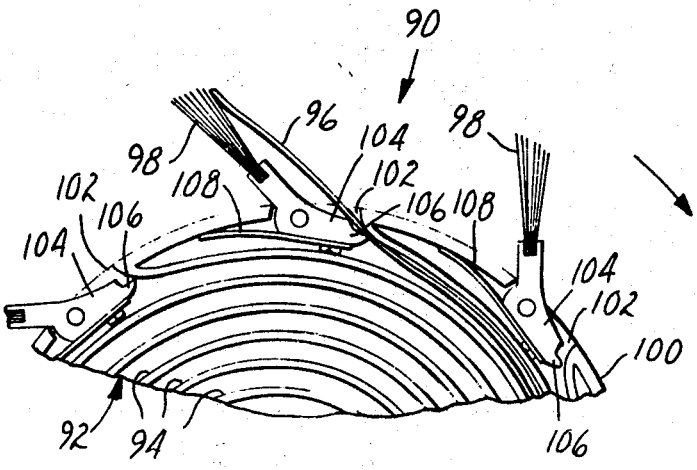
FIG. 7 is a fragmentary sectional side view of a third alternate embodiment of a sanding wheel according to the present invention.

FIG. 7 illustrates a third alternate embodiment of a sanding wheel according to the present invention generally designated by the reference numeral 90.

Like the sanding wheels 10 and 60, the sanding wheel 90 comprises a cylindrical hub assembly 92 which defines a separate helical passageway 94 for each of a plurality of lengths 96 of abrasive-coated material, from which hub assembly 92 axially projects a shaft (not shown) having a distal portion adapted to be engaged and rotated by a drive motor (not shown) to rotate the sanding wheel 90 in a first direction indicated by an arrow in FIG. 7. A plurality of flexible support members or brushes 98 identical to the brushes 16 each have one end supported on the hub assembly 92 and projecting generally radially outwardly of a cylindrical periphery 100 of the hub assembly 92. The lengths 96 of flexible abrasive-coated material each extend through a different slot 102 through the periphery 100 of the hub assembly 92, and are positioned so that their outer projecting end portions project along the surfaces of adjacent ones of the brushes 98 that lead when the wheel 90 is rotated in the first direction so that the outer end portions of the lengths 96 of abrasive-coated material can be yieldably pressed into abrasive engagement with a flat or irregular surface.

Unlike the sanding wheels 10 and 60, however, the means for releasably securing the lengths 96 of abrasive-coated material in the hub assembly 92 comprises a plurality of lock members 104 on which the brushes 98 are mounted. The lock members 104 are mounted on the hub assembly 92 adjacent its periphery 100 for individual pivotal motion about an axis parallel to the axis of the hub assembly 92, between lock positions with lips 106 on the lock members 104 pressing the lengths 96 of abrasive-coated material into engagement with walls of the hub assembly 92 defining the passageways 94 for the lengths 96 of abrasive-coated material, and released positions with the lips 106 of the lock members 104 spaced from the lengths 96 of abrasive-coated material along the passageways 94 to permit individual movement of the length 96 of abrasive-coated material into or out of the passageways 94. Leaf springs 108 are positioned between the lock members 104 and the hub assembly 92 to provide means for biasing the lock members 104 to their lock positions. The lock members 104 can be individually manually pivoted to their released positions by pushing directly on the lock members 104 or on the brushes 98, however, and the lengths 96 of abrasive-coated material can then be moved into or out of the passageways 94. The lock members 104 are positioned so that the force applied to the brushes 98 when they are pressing the lengths 96 of abrasive-coated material against a workpiece will tend to also bias the lock members 104 to their lock positions.

The present invention has now been described with reference to three embodiments thereof. It will be apparent to those skilled in the art that many changes can be made in the structure of the embodiments described without departing from the spirit of the present invention. For example, the wheel may be adapted for attachment to an arbor attached to the rotor of a drive motor, or an arbor rotatably mounted on fixed supports as are commonly found in work shops; or the support members may be provided by flexible structures other than brushes. Thus, the scope of the present invention should not be limited to the structures described in this specification, but only by the structures recited in the dependent claims and their equivalents.

We claim:

1. A sanding wheel adapted to sand irregular surfaces, said wheel comprising: a hub assembly having an axis, a periphery around said axis having a plurality of radially extending, circumferentially spaced slots, and means adapted for engagement by a drive motor to afford rotation of said hub assembly about said axis in a first direction; a plurality of flexible support members having one end fixed on said hub assembly and projecting generally radially outwardly of said periphery with each of said support members being closely adjacent the side of one of the slots that trails when said hub assembly is rotated in said first direction; a plurality of separate and nonconnected lengths of flexible abrasive-coated material each extending through one of the slots having an outer projecting end portion projecting along the adjacent support member, and having an inner end portion within the hub assembly, said hub assembly defining separated passageways for the inner end portions of said lengths of abrasive-coated material, which passageways are interleaved with each other and are helically disposed about said axis; and a separate means positioned adjacent the periphery of said hub assembly for releasably securing each of the separate lengths of abrasive-coated material to said hub assembly, and for affording, when released, individual insertion, removal and repositioning of said separate lengths of abrasive-coated material within said separated helical passageways without disassembly of said hub.

2. A sanding wheel according to claim 1 wherein said lengths of abrasive-coated material have scalloped edges; said hub assembly comprises first and second portions defining said separate helical passageway for each of said lengths of abrasive-coated material with each of said hub portions defining a different edge of each of said passageways adjacent said periphery, said hub portions having lugs adjacent said periphery adapted to engage between the scallops of said lengths of abrasive-coated material along said passageways, and being relatively axially movable between a lock position with said lugs between scallops along said lengths of abrasive-coated material to hold said lengths of abrasive-coated material in said wheel, and a released position spaced to afford movement of said lengths of abrasive-coated material along said paths in either direction past said lugs; and said sanding wheel comprises means for releasably holding said hub portions in said lock position, which, together with said scalloped edges, relatively movable hub portions, and lugs provides said means for releasably securing the lengths of abrasive-coated material to said hub assembly.

3. A sanding wheel according to claim 2 wherein said first hub portion has a through central opening; and said sanding wheel comprises a shaft coaxially fixed at one end on said second hub portion, which shaft projects through said central opening, has a distal end portion providing said means adapted for engagement by a drive motor, and is threaded adjacent said one end, and a nut threadably engaging said shaft on the side of said first hub portion opposite said second hub portion, said shaft and nut providing said means for releasably holding said hub portions in said lock position.

4. A sanding wheel according to claim 1 wherein said means for releasably securing the lengths of abrasive-coated material comprise a cam adjacent each of said slots mounted on said hub assembly adjacent its periphery for free rotation about an axis parallel to the axis of said hub assembly, and said hub assembly has a wall opposite each of said cams partially defining a passageway for the inner portion of the length of abrasive-coated material extending through the adjacent slot, said cam being rotatable between a lock position with the periphery of said cam pressing the material into engagement with the adjacent wall, and a released position with the periphery of the cam spaced from the length of abrasive-coated material along said adjacent wall to permit free movement of said abrasive-coated material into or out of said passageway, said cam being shaped and oriented so that friction alone between abrasive-coated material being pulled from said passageway will rotate said cam into its lock position.

5. A sanding wheel according to claim 1 wherein said hub assembly comprises a plurality of lock members each having a lip and being mounted on said hub assembly adjacent its periphery for rotation about an axis parallel to the axis of said hub assembly, said hub assembly has a wall opposite each of said lock members partially defining a passageway for the inner portion of one of said lengths of abrasive-coated material, each of said lock members is mounted on said hub assembly for pivotal movement between a lock position with the lip on said lock member pressing the length of abrasive-coated material along the adjacent passageway into engagement with the adjacent wall, and a released position with the lip of said lock member spaced from the length of abrasive-coated material along the adjacent passageway to permit free movement of said abrasive-coated material into or out of said passageway, and said sanding wheel comprises means for biasing each of said lock members to its release position, which together with said pivotal lock members, and walls provides said means for releasably securing the lengths of abrasive-coated material to said hub assembly.

6. A sanding wheel according to claim 1, wherein said flexible support members are brushes having nylon bristles projecting generally radially outwardly of said hub assembly.

7. In a sanding wheel adapted to sand irregular surfaces, said wheel being of the type comprising: a hub assembly having an axis, a periphery around said axis having a plurality of radially extending, circumferentially spaced slots, and means adapted for engagement by a drive motor to afford rotation of said hub assembly about said axis in a first direction; a plurality of flexible support members having one end fixed on said hub assembly and projecting generally radially outwardly of said periphery with each of said support members being closely adjacent the side of one of the slots that trails when said hub assembly is rotated in said first direction; a plurality of lengths of flexible abrasive-coated material each extending through one of the slots having an outer projecting end portion projecting along the adjacent support member, and having an inner end portion within the hub assembly; and means for releasably securing the lengths of abrasive-coated material to said hub assembly, the improvement wherein said lengths of abrasive-coated material are separate, nonconnected, and have scalloped edges; said hub assembly comprises first and second portions defining a separate helical passageway for each of said lengths of abrasive-coated material with each of said hub portions defining a different edge of each of said passageways adjacent said periphery, said hub portions having lugs adjacent said periphery adapted to engage between the scallops of said lengths of abrasive-coated material along said passageways, and being relatively axially movable between a lock position with said lugs between scallops along said lengths of abrasive-coated material to hold said lengths of abrasive-coated material in said wheel, and a released position spaced to afford movement of said lengths of abrasive-coated material along said paths in either direction past said lugs; and said sanding wheel comprises means for releasably holding said hub portions in said lock position, which, together with said scalloped edges, relatively movable hub portions, and lugs provides said means for releasably securing the lengths of abrasive-coated material to said hub assembly.

8. A sanding wheel according to claim 7 wherein said first hub portion has a through central opening; and said sanding wheel comprises a shaft coaxially fixed at one end on said second hub portion, which shaft projects through said central opening, has a distal end portion providing said means adapted for engagement by a drive motor, and is threaded adjacent said one end, and a nut threadably engaging said shaft on the side of said first hub portion opposite said second hub portion, said shaft and nut providing said means for releasably holding said hub portions in said lock position.

* * * * *